United States Patent [19]

Bianchi et al.

[11] Patent Number: 5,033,663

[45] Date of Patent: Jul. 23, 1991

[54] MILITARY HOLSTER WITH INTERCHANGEABLE WELT

[76] Inventors: John E. Bianchi; Richard D. E. Nichols, both of 100 Calle Cortez, Temecula, Calif. 82390

[21] Appl. No.: 856,792

[22] Filed: Apr. 25, 1986

Related U.S. Application Data

[62] Division of Ser. No. 655,036, Sep. 26, 1984, Pat. No. 4,627,558.

[51] Int. Cl.[5] ..... F41C 33/02

[52] U.S. Cl. ..... 224/238; 224/240; 224/235; 224/243; 224/192

[58] Field of Search ..... 224/911, 238, 249, 235, 224/243, 192

[56] References Cited

U.S. PATENT DOCUMENTS

| | | | |
|---|---|---|---|
| 3,252,639 | 5/1966 | Sloan | 224/911 X |
| 3,923,214 | 12/1975 | Kippen | 224/911 X |
| 4,084,734 | 4/1978 | Bianchi et al. | 224/911 X |
| 4,277,007 | 7/1981 | Bianchi et al. | 224/911 X |
| 4,286,741 | 9/1981 | Rogers | 224/911 X |

*Primary Examiner*—Henry J. Recla

*Attorney, Agent, or Firm*—Wagner & Middlebrook

[57] ABSTRACT

A holster which is designed to carry securely a number of different sizes of handguns with equal proper fit. The holster is preferably formed of a composite fabric-foam-fabric material, or in certain cases, of leather. The holster sides are secured together partially in the region adjacent to the underside of the frame near the trigger guard. A separate welt member is securable between the two sides of the holster and presents to the frame in the region of the trigger guard, a smooth conforming surface which urges the handgun into a snug fit within the holster. A typical interchangeable welt is a thick rubber or rubber-like washer with a radius conforming to the curve of the front of the trigger guard as it joins the frame toward the front of the handgun. The interchangeable welt may be held in place by a screw and nut or other fastener which may pass through opposite sides of the holster.

3 Claims, 5 Drawing Sheets

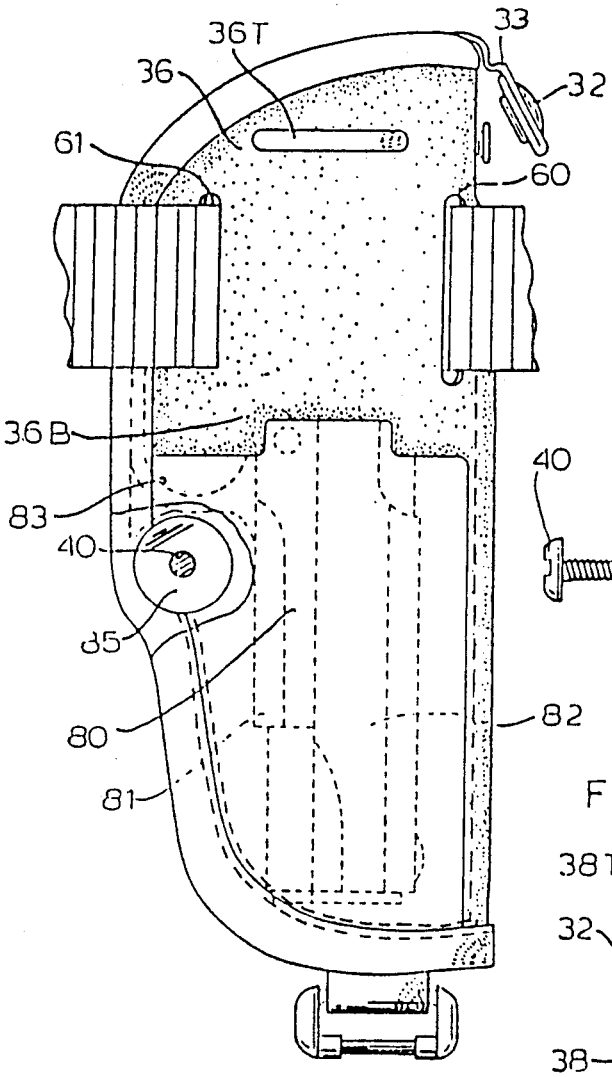
FIG. 6
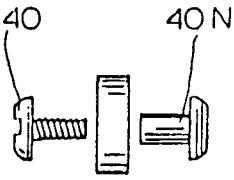
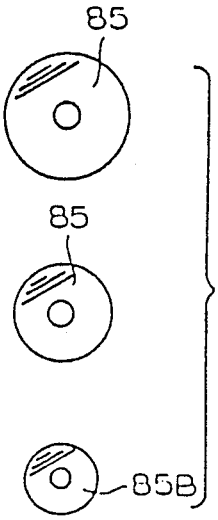
FIG. 8
FIG. 7
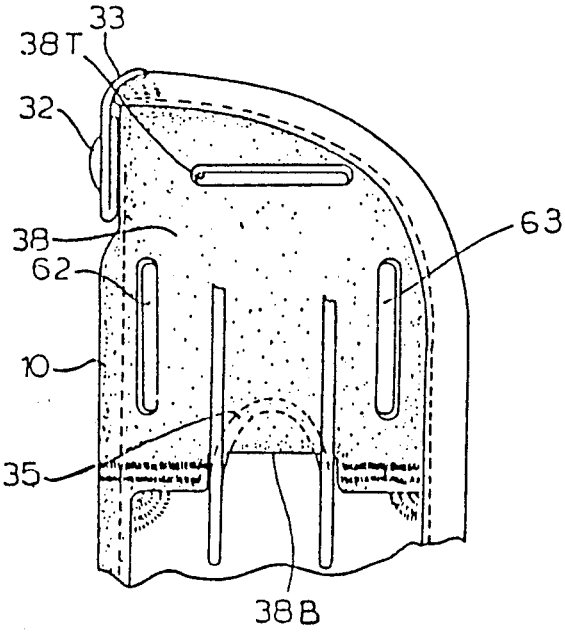
FIG. 15

MILITARY HOLSTER WITH INTERCHANGEABLE WELT

This application is a division of application Ser. No. 06/655,036 filed Sept. 26, 1984 and now U.S. Pat. No. 4,627,558.

BACKGROUND OF THE INVENTION

Despite the many years of development of holsters for sporting and military use, there has yet to be achieved a holster totally suitable for use by a military man as an ambidextrous belt holster suitable for wide and narrow belts and also adaptable as a shoulder holster. A large variety of holsters have been developed, each with a design to fit a single weapon and to be worn in one or possibly two different methods, for example, side draw or cross draw.

In U.S. Pat. No. 3,688,953 of one of the co-inventors hereof, the first ambidextrous military holster was developed. It was designed to be worn on either a standard or web pistol belt up to 2¼ inches wide or a narrower garrison or trousers belt. The holster could be worn either left handed or right handed, front or cross draw. The co-pending application Ser. No. 575,313, filed Jan. 30, 1984, discloses a further development in adaptable ambidextrous holsters including an adjustable height feature. These both constituted remarkable advances in the state of the art; however, neither are fully adaptable to a variety of sizes of weapons, exhibited some excess bulkiness and are not adapted to shoulder harness wear.

The need to provide an ambidextrous holster to account for the significant number of left-handed shooters continues to exist for shoulder holster wearers as it did prior to the invention of the ambidextrous belt holster disclosed in U.S. Pat. No. 3,668,953 above.

Any shoulder holster, to meet universal needs for the military, likewise needs to be wearable for both left-hand, crossdraw and right-hand, crossdraw. A further need exists for a reliable, comfortable ambidextrous leg holster.

In the interest of minimization of military supply requirements, it would be desirable that a single holster be usable in many different modes of wearing, namely when belt worn, left-hand sidedraw, right-hand sidedraw, left-hand crossdraw and right-hand crossdraw. When shoulder worn, it would be desirable to be usable in left-hand crossdraw or right-hand crossdraw. In any mode, the holster may be worn with or without the flap or safety strap.

The primary function of the holster is to safely carry a handgun and to allow it to be brought into use effectively, rapidly and without interference while the handgun is being drawn. A further requirement being imposed upon the military is that in strenuous activity such as jumping in and out of a helicopter, or entering or leaving the confined quarters of a tank or other motorized vehicle, that the holster not interfere with that movement and also that the handgun not be dislodged by contact of the holster with any part of the vehicle or any other object during the military man's maneuver.

Because of these needs, holsters have characteristically included either a flap or safety strap and have been custom designed to fit a particular weapon with precise shaping of the handgun pouch to fit the particular weapon and barrel length. Such a design criteria is inconsistent with the need to produce a universal military holster which could carry a variety of different model handguns. In one previous holster, a movable welt has been used to adapt the holster to different size handguns.

BRIEF DESCRIPTION OF THE INVENTION

Faced with the foregoing state of the art, we undertook to meet each of the true needs for a universal military holster with the result that we have developed a modular system including a basic holster body using a composite fabric as the preferred material and formed into a pouch of sufficient size to carry the largest handgun desired and include an adjustable removable and changable welt member which is located adjacent to the frame in front of the weapon below the finger guard of the handgun and biases the handgun forward in the pouch to assure its solid location within the holster.

The interchangable welt is preferably in the form of a circular rubber or resilient washer-like member providing positive contact with the frame and a curved surface which generally corresponds to the curved surface of the fillet joining the finger guard to the frame. The welt member comes in a variety of diameters, the larger diameters used in conjunction with the smaller handgun.

The welt member may be secured in place permanently as by rivet or may be interchangably held in place by a screw and nut. The welt member, being symmetrical, may be rotated slightly to bring a new area of the circular welt member into contact with the handgun if the welt member has become worn due to repeated contact with the handgun through use. The welt member also keeps the handgun from contacting the fabric or material of the holster during drawing or replacing the handgun in the holster thereby reducing wear on the holster body and any stitching.

On one side of the holster body are a plurality of slots, namely two generally horizontal slots, one above the other and two generally vertically oriented slots spaced side by side. The vertical slots allow the handgun to be worn directly on a standard leather belt. The horizontal slots are used in cooperation with a novel clip of this invention to allow the handgun to be supported from a larger web belt and the adaptor of this invention to be attached to a shoulder or chest harness. Both sides of the holster body have similar four slot arrangements whereby the holster is ambidextrous and ether side may act as the outer side of the holster.

The holster includes a choice of a flap or a safety strap or both. The holster flap includes a D ring at one end which engages the clip member mentioned above and extends over the top opening of the holster and is secured at its outer side by a resilient strap and tucked fastener. The resilient strap holding the holster flap closed is located in a fabric tunnel extending longitudinally on the underside of the flap. The end of the flap strap includes a D ring handle large enough that it may be grasped by a gloved hand and includes a reverse stiff strap member positioned and dimensioned to tuck under one of the horizontal slots in the then outer face of the holster. The holster flap is closed by grasping the D ring, pulling it outward and downward until it extends below the horizontal straps and slowly releasing the D ring whereby the reverse inner stiff end of the strap rides up through the horizontal slot in the holster body. A front pouch on the holster holds a barrel cleaning rod which further serves to aid in threading the various straps through the slots in the holster when changing the mode of wearing the holster.

The universal clip member of this invention is used to hold the holster to a wide webbed belt or to hold other devices to a webbed belt. It comprises a generally planar body of metal or other stiff material having a rolled or otherwise formed laterally extending hinge-pin socket which extends generally from side to side. A wire formed member includes a central portion passing though the pin socket to form a pivotal connection with the body member. The clip wire form includes a pair of legs defining a generally rectangular shaped opening dimensioned to match a web belt and a pair of elongated feet which engage a pair of roll formed catches in the lower sides which hold the legs in place by the spring characteristics of the wire form legs.

The clip is dimensioned so that it may be slipped through the pair of horizontal slots in either side of the holster body in order to secure the clip to the holster body for web belt wearing on either left or right side for either left or right handed draw. The clip may also be used for securing the holster to the shoulder harness.

BRIEF DESCRIPTION OF THE DRAWINGS

This invention may be more clearly understood from the following detailed description and by reference to the drawings in which:

FIG. 6 is an inside elevational view partly broken away of the holster of this invention with a fragmentary section of a conventional leather belt and a phantom illustration of the frame, trigger guard and muzzle portions of a government model 0.45 caliber automatic weapon in its normal position in the holster;

FIG. 7 is a side elevational view of the interchangable welt and fastener of FIG. 6;

FIG. 8 is a side elevational view of three different interchangable circular welt members for different size handguns;

FIG. 15 is a fragmentary side elevational view of the opposite side view of FIG. 6;

DETAILED DESCRIPTION OF THE INVENTION

Figure 1:
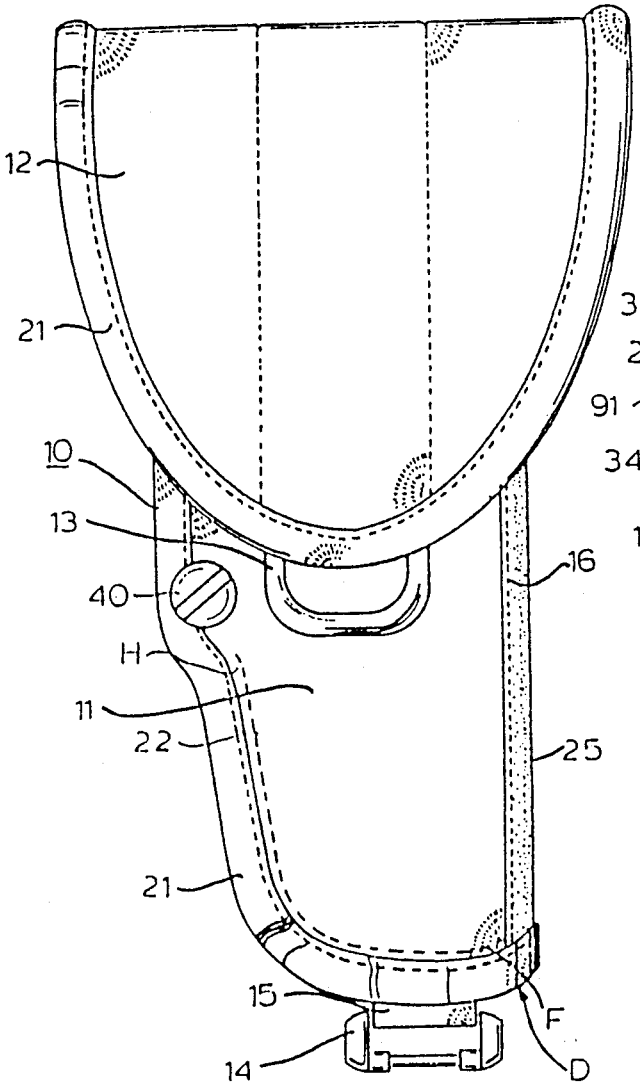
FIG. 1 is an outer side elevational view of this invention as a belt worn flap holster.

The universal modular holster 10 of this invention may be seen in FIG. 1 as viewed from the outer side 11 with a flap 12 in place and closed. The holster 10 includes a D ring 13 extending below the bottom of the flap 12 used to open the flap and a bottom ring 14 secured within a fabric loop 15 to the bottom of the holster 10. The ring 14 may be used to tie down the bottom of the holster 10 or to lash it to other equipment.

The front face 16 of the holster includes an overlying reinforcement layer 20. The reinforcement 20, best seen in FIGS. 2, 3 and 6, to which reference is also made, may be of elastomer material such as urethane while the holster 10 body and flap 12 are preferably manufactured from a composite material employing a closed cell polyurathane foam of approximately ¼ inch (0.635 cm.) thickness, covered on its outer face with 1020 denier ballistic Nylon and lined on its inner face with 420 denier rip-stop Nylon. Of course, other materials such as leather or other fabrics may be used in the manufacture of this invention but the foregoing materials are recommended. The result is a holster which is approximately ⅓ lighter than a comparable leather holster, provides foam padding for the handgun, will function over a wide temperature range and is extremely water resistent. The materials are highly resistent to absorption of dirt, mud, grease and are readily washable. These materials produce a holster which is dyefast in color, nonreflective and quiet in operation. The laminate is self-molding to the handgun shape yet can be crushed compactly for shipping and storage. A high degree of abrasion resistence is demonstrated by the ballistic Nylon facing and the rip-stop Nylon liner is protective of handgun finishes. The foam liner acts as a cushion for the handgun from external impacts. For these reasons, the above identified materials are favored.

The edges of the composite material are sealed by ribbed Nylon binding 21. The lower edges of the holster 10 body are held together by a stitch line 22 extending through to the outer face 11 and the inner face 23 from a point approximately the lower ⅓ of the holster height at H to the lower front F. The stitch line 22 is terminated short of the front 16 in order to define a drain hole D indicated by the arrow in FIG. 1.

Figure 2:
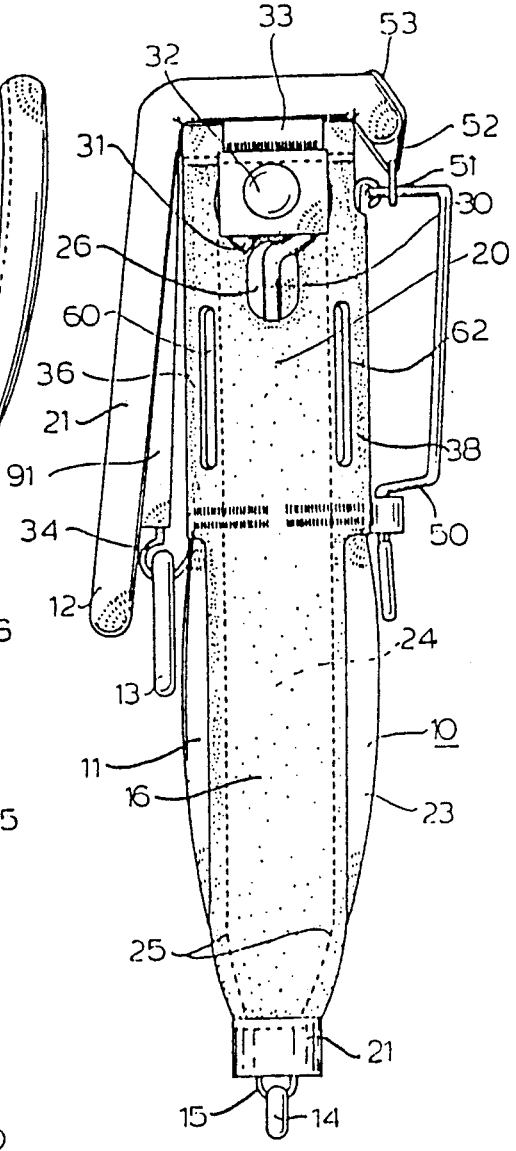
FIG. 2 is a front elevational view thereof.

The holster 10 provides an elongated pocket 24, best seen in FIG. 2, between the holster reinforcement 20 and the body of composite material. The pocket 24 indicated by a dashed line in FIG. 2 is defined by stitch lines 25 and terminates at its upper end at an opening 26, of FIG. 2 out of which a cleaning rod 30 extends. The rod 30 characteristically is a straight rod with a finger sized loop 31 at one end and a slot (unshown) at its opposite end or receiving a barrel cleaning cloth. The rod 30 is held in place not only by friction within the pocket 24 but by a snap fastener 32 attached to a small front flap 33 secured to the top front of the holster 10 body.

The cleaning rod 30 stiffens the front of the holster 10 in addition to providing its normal function. There is little danger of its loss while being carried since it remains securely within the holster pocket 24 under flap 33 and snap 32.

The holster 10 in FIG. 1 shows the head of a screw 40, the function of which becomes apparent in connection with FIGS. 6, 7 and 8. Visible in FIG. 2 is the connection of the flap 12 to the holster both at its top rear end and its lower front end. The D ring 13 which extends partially below the tip of flap 12, is secured to an elastic strap 34 (unshown in FIG. 1 but appearing in FIGS. 2, 11 and 12) by a wireform catch 35 which secures the flap 12 in place by extending under an outer side extension 36 of the reinforcement 20 of FIG. 2. The extension 36 is best seen in FIG. 6 with the loop end 37 in its exposed position in FIGS. 9–12 and in locking position in FIGS. 2 and 14. The operation of this flap locking feature is further described in connection with FIGS. 9–14.

FIG. 2 further illustrates that the inner end of flap 12 is removably secured to a clip or hanger 50 by a ring 51 and fabric loop 52 which is stitched to the inner end 53 of the flap 12. Both the hanger 50 and flap 12 may be removed from the holster 10 body and reversed to convert the left or right handedness of the holster. The hanger 50 is designed to attach the holster 10 to a wide or web belt.

Also visible in FIG. 2 are two of four vertical slots 60–63 with the slots 60 and 61 located on the extension 36 of reinforcement 20 while vertical slots 62 and 63 are located in extension 38 of reinforcement 20. Slots 60 and 61 are used as illustrated in FIG. 6 to belt mount the holster on the left side of the wearer while the slots 62 and 63 on the opposite side are used to belt mount the holster on the right side of the wearer.

CONVENTIONAL BELT MOUNTING AND HANDGUN SIZE ADJUSTMENT

Referring now to FIG. 6, the same holster 10 is shown mounted on a conventional e.g. leather or garrison belt B, via the slots 60 and 61. The slots 36T and 36B are unused and the flap has been removed for clarity. Shown in dashed line form in FIG. 6 is the outline of the lower half of a Colt Government Model 0.45 caliber automatic handgun 80 including a frame 81, slide 82 and a trigger guard 83. These are shown in the normal location within the holster 10 when fully seated. Note that the region of the near face of the holster body has been broken away in the area of the screw 40 of FIG. 1. This reveals the internal interchangable resilient welt 85 of this invention held in place by the screw 40 and its mating nut 40N appearing in FIG. 7. Note that the welt 85 is circular in shape and of sufficient diameter such that it conforms closely to the curve of the handgun 80 where the frame 81 joins the trigger guard 83. The welt 85 therefore determines the most rearward and most downward limit of travel of the handgun 80 as it is holstered. The welt 85 is preferably of neoprene rubber providing sufficient strength to properly hold the handgun in place and sufficient resiliency to absorb the pressures of entrance and removal of the handgun and sufficient friction properties to provide a non-slip grip surface on the handgun. The welt member 85 also prevents contact of the handgun with the stitching at the lowermost portion of the handgun opening to extend the life of the holster.

As illustrated in FIG. 6, the welt member 85 is interchangable merely by removal of screw 40 and replacement with a different size conforming to the height of the handgun as measured from the frame to the top of the barrel or slide immediately in front of the trigger guard. In the examples given, the welt 85A of FIG. 8 is in actual practice approximately 1 inch in diameter and $\frac{3}{8}$ inch in thickness. This dimension matches the Browning HI-Power 9 mm. handgun. The welt 85 of FIGS. 6 and 8 is approximately $\frac{7}{8}$ inch in diameter and suitable for the Colt government model 0.45 caliber automatic. The welt 85B of FIG. 8 is approximately $\frac{3}{4}$ inch in diameter and likewise $\frac{3}{8}$ inch thick matching the Beretta MA2 9 mm. weapon.

Mere removal of screw 40 and its nut 40N and exchange of welts 85 can change the holster from very large frame to small frame military type weapons. Another important matter to note is that the welt 85, being symmetrically round, can be rotated if the surface engaging the frame and trigger guard becomes worn due to excessive use. By merely rotating the welt 90 degrees, a new surface is brought into engagement with the handgun.

Some handguns include a spur marked in dash dot lines in the drawing FIG. 6. This spur 60, at the lower front of the finger guard 83, increases the surface contact with the welt and enhances its operation.

WEB BELT MOUNTING

Figure 3:
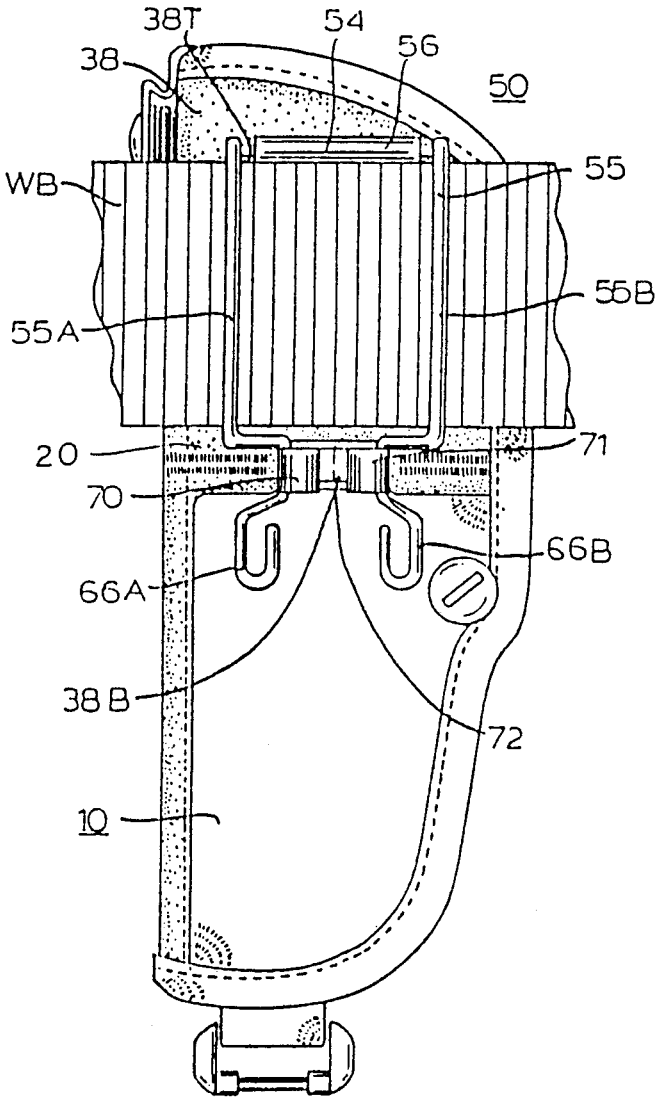
FIG. 3 is an inside elevational view of the holster of this invention without a flap but employing a clip hanger of this invention to allow the holster to be carried on a web belt.
Figures 4, 5:
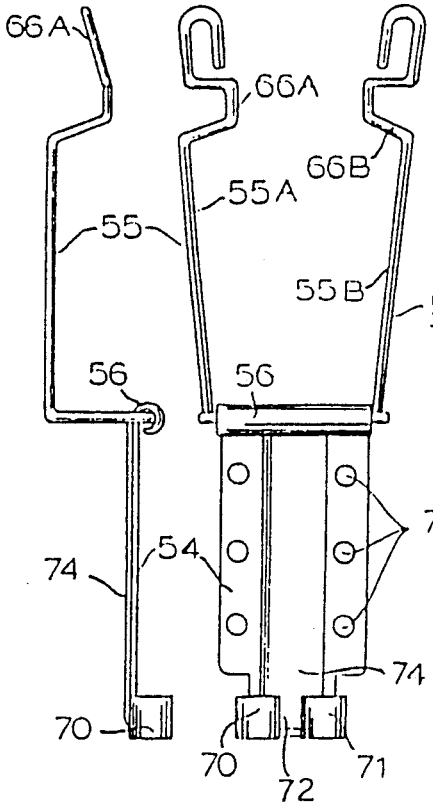
FIG. 4 is a side elevational view of the clip hanger of this invention.
FIG. 5 is a front elevational view thereof.

Now referring to FIGS. 3–5, the holster 10 is shown worn on a web belt 70 in the order of $2\frac{1}{4}$ inches in width. The holster 10 is held on the belt WB by handgun clip assembly 50 including a body portion 54 and a wire form member 55. The body 54 includes an integral hinge 56 at the top formed into a roll and extending generally across the width of the body 54 and holding as a hinge pin, the central section of the wire form member 55 having a pair of legs 55A and 55B. The body 54 defines a pair of rolled catches 70 and 71, each of which engage the respective knee portions 66A and 66B of the leg 64A and B. The inherent spring properties of the wire form 55 which is made preferably of 1/16 inch spring steel, hold the knees 66A and 66B in place within the catches 70 and 71 after the two legs 55A and 55B are squeezed together and passed through the opening 72 in the catch region.

In FIG. 5, a plurality of holes 73 are shown in the body 54 as well as a longitudinal reinforcing rib 74. The holes 73 are not used in connection with this holster but are useful in applying the clip to holding other types of devices, e.g. canteen or other carrying device, on a belt.

The clip 50 engages the horizontal slots T and B on either side of the holster as shown in FIG. 6 thus making it ambidextrous for web belt use as well.

FLAP HOLSTER

Figure 9:
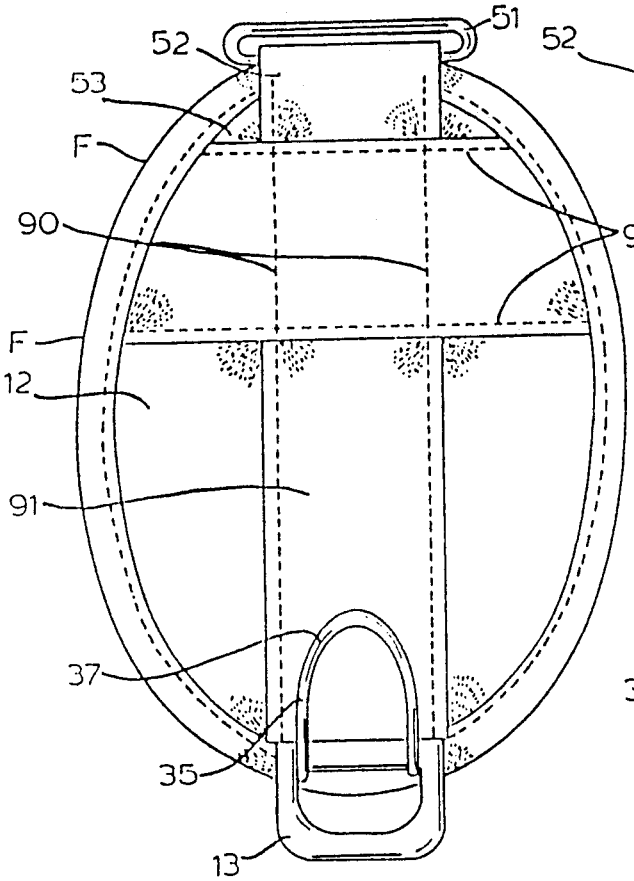
FIG. 9 is an underside plan view of the flap of FIGS. 1 and 2.
Figure 10:
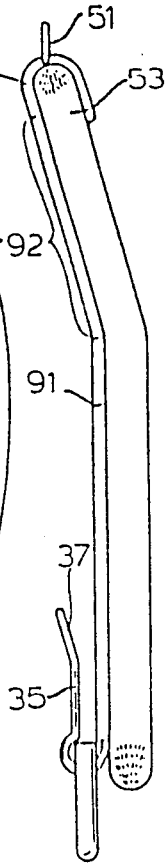
FIG. 10 is a side elevational view of the flap of FIG. 9.

Now referring to FIGS. 9–12 in conjunction with FIGS. 1 and 2, the flap 12 of FIG. 9 is preferably of fabric material similar to the body of the holster 10 and includes a pair of longitudinal stitch lines 90 which define a tunnel 91 visible in FIGS. 2, 9 and 10. The elastic strap 34, appearing in FIGS. 11 and 12, extends in the tunnel 91 and is secured by a pair of transverse stitch lines 92 which serve to define fold lines for the holster flap at approximately the points F in FIG. 9. The elastic strap 34, therefore, may be stretched from a point at the lower F line downward. After encircling the upper end of wire 35 and ring 13, the end of strap 34 is secured within the tunnel 91 and is stitched over wire 35 and terminated in a plastic end 37 which is generally pointed and tapered. The end 37 is dimensioned to slide into either the slots 36B and 38B in the holster body and by reason of the inherent elasticity of the strap 34, holds the flap 12 in a closed position.

The holster 10 may be opened merely by downward pressure of a finger or gloved finger, on the D ring 13 until the end tab 37 exits the slot 36B or 38B of FIGS. 6 or 15, respectively and the flap 12 thereafter released.

Figure 11:
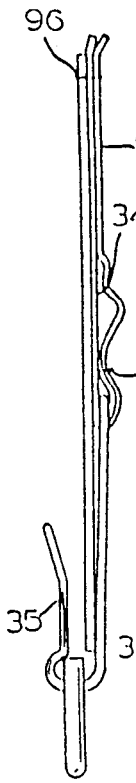
FIG. 11 is a side elevational view thereof of the extensible flap catch of the flap of FIG. 9.
Figure 12:
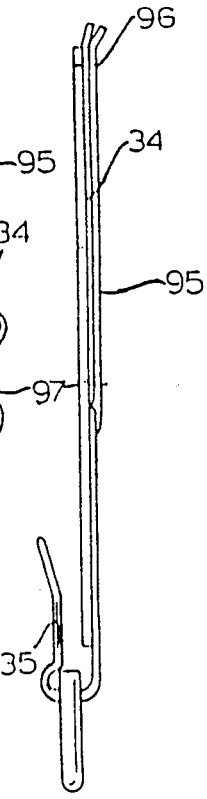
FIG. 12 is a side elevational view of the extensible flap catch of FIG. 11 fully extended.

Now referring to FIGS. 11 and 12, shown is the extensible strap 34 which is shown removed from the tunnel 91. As indicated above, the strap 34 is elastic and stretchable to release the holster flap 12. To avoid the possibility of overstretching strap 34, on its underside is a nonextensible fabric strap 95 sewn together to the strap 34 by the stitch lines 96 in the holster or by separate stitching and preassembly. The nonextensible strap 95 is secured at its lower ends to strap 34, for example by a stitch line 97. In FIG. 11, the strap 34 is in its nonextended condition and the nonextensible strap 95 is shown loose. When downward pressure is applied to the D ring 13, the extensible strap 34 is stretched until limited by the nonextensible strap 95. There is sufficient extension to allow release of the holster flap 12 but no danger that the elastic limit of strap 34 is exceeded. This insures long life of the holster flap securing means.

Figure 13:
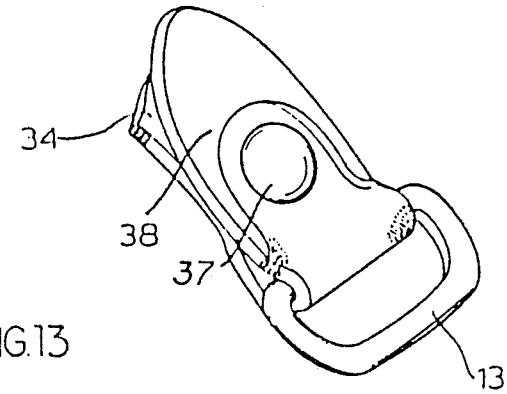
FIG. 13 is a fragmentary perspective view of an alternate form of flap catch.
Figure 14:
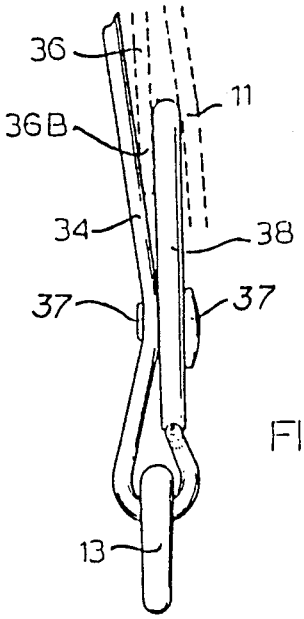
FIG. 14 is a side elevational view of the alternate form of flap catch of FIG. 13.

An alternate embodiment of the flap catch of this invention is illustrated in FIGS. 13 and 14. As shown therein the elastic strap 34 is secured by an ornamental rivet 37 extending through end tab 38 which is preferably of molded plastic. The end tab 38 includes a recess, unshown in the drawing, which receives the end of elastic strap 34 after it encircles D ring 13. The head of the rivet 37 is nearly flush with the upper surface 38T of end tab 38 so that it does not interfere with engaging and disengaging the strap 34.

As seen in FIG. 14, the end tab 38 extends into the slot 36B formed between the outer surface 11 of the holster body and the side extension 36 of the reinforcement layer 20. The elasticity of strap 34 draws the tab 38 upward with movement of the wearer. A mere downward and outward pull on the D ring 13 releases the strap 34 and flap.

THE HOLSTER USING A RETAINER STRAP

The strap 34, as it appears in FIGS. 11 and 12 with suitable end ring such as ring 51 of FIG. 9 at the upper end may be used instead of a flap. The same operation as described above is used for latching and unlatching the strap. The strap holster version is illustrated in use in FIG. 16, and in greater detail in FIG. 16A.

It may be wondered why the elastic strap fastener 34 is employed. We have found that it gives reliable holding of the flap 12 in place and if the flap brushes against some object by movement of the military man, the strap 34 gives a degree of freedom of movement of the flap without becoming disengaged. In fact, the flap can be moved downward, sideward and upward without becoming released. When the military man wants to release the flap, a mere noiseless, downward pressure on D ring 13 releases the flap 12. There is none of the snapping sound of a snap fastener or the tearing sound relating to hook and pile fasteners. It is rapid, silent and reliable.

The versatility of this invention is illustrated in FIGS. 16–19 which illustrate three of the many ways of wearing the holster of this invention.

Figure 16:
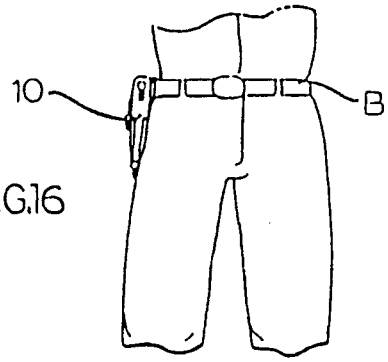
FIGS. 16 and 17 are front views of a wearer of this invention in right and left sidedraw configuration respectively.
Figure 17:
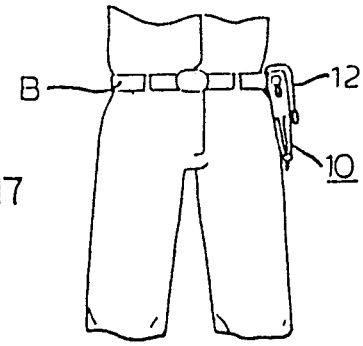

In FIG. 16, the holster 10 is worn on the right side on a conventional dress belt B. The holster is worn for normal right hand draw and is shown without a flap. The handgun 110, unshown in FIG. 16 but appearing in FIG. 16A, may be carried without a strap or may be retained by an elastic strap similar to strap 34 and catch 37 of FIGS. 11 and 12 or 13 and 14, and secured to the rear side of the holster through slots 38T and 38B of FIG. 15.

Figure 16A:
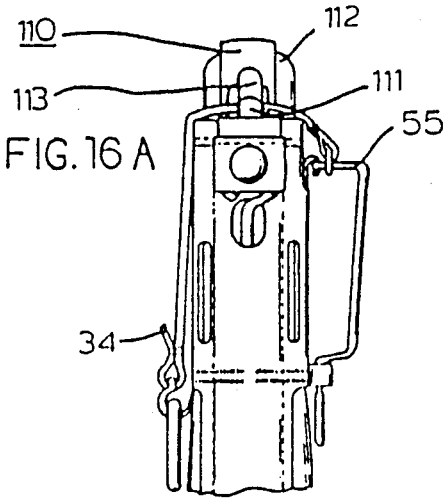
FIG. 16A is a fragmentary front elevational view of this invention using a strap instead of a flap.
Figure 19:
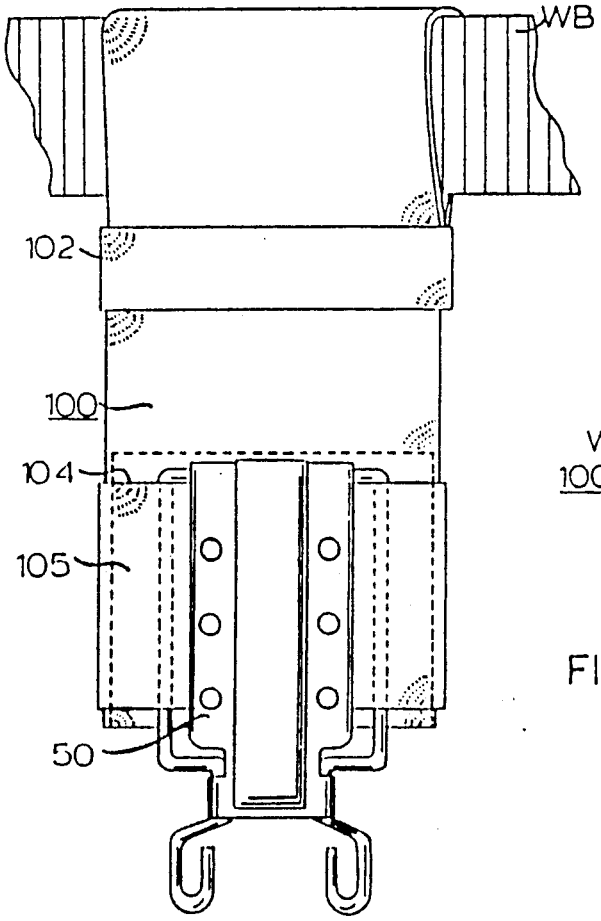
FIG. 19 is an enlarged front elevational view of the leg hanger of FIG. 24.

In FIG. 16A, the elastic strap 34 has an end loop 34L encircling a D ring 51 similar to the ring of the same designation in FIG. 2 encircling the legs 55A and B. Strap 34 extends over the top of handgun 110 behind the hammer 111 and ahead of the grip 112. The strap 34, similar to FIGS. 10 and 14, terminates in an end fastener which may be either a wire form 35 as shown in FIGS. 10–12 or a plastic tab 138 as appears in FIG. 14. In either case, the end tab 35 extends into the slot 38B or its counterpart slot 36B on the opposite side of the holster. The strap configuration is operated in the same general manner as the flap version of this invention.

The holster 10 may also be worn on the left side with the flap 12 worn and secured as shown in FIGS. 1 and 2. This mode gives protection for the handgun from weather.

LEG HOLSTER

In certain applications, a leg holster is preferred over a belt or shoulder holster Some helicopter pilots and armored vehicle drivers seek to minimize the bulk around their waist and favor the accessability of leg carrying. The leg holster arrangement of FIGS. 18 and 19 accomplish this objective. Either a conventional belt B or a wide belt WB may carry a holster hanger 100 which includes a belt loop 101 formed by looping through a strap 102 to form a bight. Downward pressure on the body 103 of the hanger 100 tends to tighten the loop 101 securely around the belt WB. The same action will tighten the hanger 100 about a conventional belt B.

The hanger 100 includes an open bottom pocket 104 across the body of hanger 100 formed by a second cross strap 105 which is sewn or otherwise secured to the hanger 100 at its ends, (the edges of hanger 100).

Figure 18:
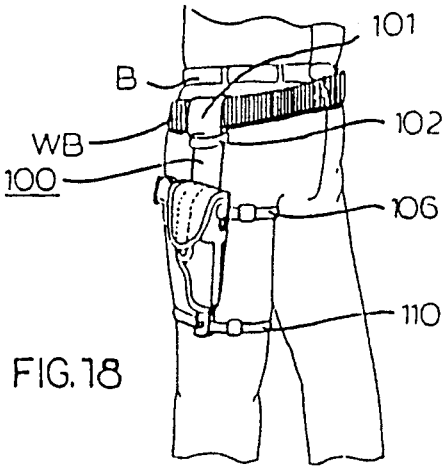
FIG. 18 is a front quarter view of a wearer with this invention as a leg holster.

The strap 105 is of approximately two inches in width whereby the clip 50 of FIGS. 2–5 may be secured to the pocket 104 and holster 10 as illustrated in FIG. 18. Additional straps 106 and 107 encircle the wearer's leg and hold the holster securely to the leg. Strap 106 may pass through the clip 50 while strap 110 can pass through ring 14 of FIGS. 1 and 2 or may have its own vertical strap 108 secured to ring 14 (unshown in FIG. 18). In any case, employing the holster body 10, clip 50 and hanger 100, the holster is a fully functional leg holster.

SUMMARY

It may be seen that through the novel design of the holster body, clip, flap, catch, belt loop slots, hanger and interchangable welt members, a truly universal military holster has been developed. The cooperation of each of these novel components results in a single holster which meets the basic need of wide and narrow belt webbing, left or right hand, conventional or cross draw and shoulder, chest or leg wearing employing the hanger disclosed herein or the shoulder strap assembly of our co-pending application.

The foregoing constitutes a disclosure of the best mode known to us for carrying out this invention but is by no means limited to the embodiments illustrated. The scope of this invention is instead determined from the following claims and their equivalents.

What is claimed is:

1. A holster adapted to carry a variety of sizes and shapes of handguns comprising a sheet of material folded to define a pouch between a pair of faces with a seam along a part of one edge of a folded portion defining the front of the holster and top opening for the intersection and withdrawal of a handgun from said pouch;

interchangeable welt means comprising one of a plurality of different sized curved members each providing a different clearance between the stitch line edges and the opposite edge of said holster;

means for securing said interchangeable welt means in the region of the upper edge of the seam and the lower portion of said opening to provide different size handgun openings in said holster; and different ones of said interchangeable welt means art calibrated in diameter for different sizes of handgun frames.

2. The combination in accordance with claim 1 wherein the curved surface constitutes the edge of a washer-like member.

3. The combination in accordance with claim 1 wherein said interchangeable welt means is resilient rubber like material.

* * * * *

UNITED STATES PATENT AND TRADEMARK OFFICE

CERTIFICATE OF CORRECTION

PATENT NO. : 5,033,663

DATED : Jul. 23, 1991

INVENTOR(S) : John E. Bianchi and Richard D.E. Nichols

It is certified that error appears in the above-identified patent and that said Letters Patent is hereby corrected as shown below:

Column 2, line 48, change "ether" to --either--.

Column 8, line 23, after "holster" insert --.--.

Signed and Sealed this

Fifteenth Day of December, 1992

*Attest:*

DOUGLAS B. COMER

*Attesting Officer*

*Acting Commissioner of Patents and Trademarks*